US009109471B2

(12) United States Patent
Kido et al.

(10) Patent No.: US 9,109,471 B2
(45) Date of Patent: Aug. 18, 2015

(54) CAM STRUCTURE

(71) Applicant: MITSUBISHI JIDOSHA KOGYO KABUSHIKI KAISHA, Tokyo (JP)

(72) Inventors: Yusuke Kido, Okazaki (JP); Akira Yoshihara, Kyoto (JP); Toshihiko Oka, Anjo (JP); Shinichi Murata, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/226,445

(22) Filed: Mar. 26, 2014

(65) Prior Publication Data

US 2014/0290602 A1 Oct. 2, 2014

(30) Foreign Application Priority Data

Mar. 27, 2013 (JP) ..... 2013-066860

(51) Int. Cl.

| | |
|---|---|
| ***F01L 1/04*** | (2006.01) |
| ***F01L 1/08*** | (2006.01) |
| ***F01L 1/14*** | (2006.01) |
| ***F01M 9/10*** | (2006.01) |
| ***F01M 11/02*** | (2006.01) |
| *F01L 1/16* | (2006.01) |
| *F01L 1/32* | (2006.01) |

(52) U.S. Cl.

CPC ... *F01L 1/08* (2013.01); *F01L 1/14* (2013.01); *F01L 1/143* (2013.01); *F01M 9/101* (2013.01); *F01M 11/02* (2013.01); *F01L 1/16* (2013.01); *F01L 1/32* (2013.01); *F01L 2105/00* (2013.01)

(58) Field of Classification Search

CPC ..... F01L 1/08; F01L 1/14; F01L 1/143; F01L 2105/00

USPC ..... 123/90.16, 90.48, 90.6; 29/888.1

See application file for complete search history.

(56) References Cited

U.S. PATENT DOCUMENTS

| | | | | |
|---|---|---|---|---|
| 2,933,949 | A | 4/1960 | Bouwkamp | |
| 5,404,845 | A | 4/1995 | Hannibal et al. | |
| 5,694,892 | A | 12/1997 | Reatherford | |
| 8,225,756 | B2 * | 7/2012 | Schoen et al. | 123/90.16 |
| 2012/0073534 | A1 | 3/2012 | Tanaka et al. | |

FOREIGN PATENT DOCUMENTS

| | | | |
|---|---|---|---|
| DE | 44 10 381 | A1 | 10/1994 |
| DE | 196 18 253 | C1 | 8/1997 |

(Continued)

OTHER PUBLICATIONS

Extended European Search Report dated Sep. 12, 2014 for corresponding European Application No. EP 14 16 1828.

*Primary Examiner* — Ching Chang

(74) *Attorney, Agent, or Firm* — Birch, Stewart, Kolasch & Birch, LLP

(57) ABSTRACT

A cam structure driving a tappet having a crowning on a top face and connected to a base end section of an intake or exhaust valve of an engine, includes: a camshaft rotating in synchronization with a crankshaft of the engine; a cam lobe mounted on the camshaft, and including: a base cam including: a base circular section having a mounting hole for the camshaft; and a valve lift section having a cut-out section in a tip end portion; and a roller provided in the cut-out section and having a cylindrical section with a constant diameter. A center section in a width direction of the base cam makes contact with the tappet at a position deviated from a center of the top face of the tappet, and the cylindrical section makes contact with the center of the top face of the tappet.

15 Claims, 5 Drawing Sheets

(56) References Cited

FOREIGN PATENT DOCUMENTS

| | | | |
|---|---|---|---|
| EP | 2 505 796 | A2 | 10/2012 |
| JP | 2011-80372 | A | 4/2011 |
| JP | 2011-117415 | A | 6/2011 |
| JP | 2012-202355 | A | 10/2012 |

* cited by examiner

CAM STRUCTURE

BACKGROUND

The present invention relates to a cam structure equipped with a roller and constituting a valve mechanism of an engine.

A cam structure equipped with a roller is known as a type of a cam constituting a valve mechanism of an engine. For example, JP-A-2011-80372 and JP-A-2012-202355 disclose cam structures in each of which a roller is mounted on a base cam having a base circular section and a valve lift section. The roller is provided in a cut-out section formed at the tip end of the valve lift section and mounted so that part of its outer peripheral face protrudes outward from the outer peripheral face of the valve lift section.

This type of cam equipped with a roller is mounted on a camshaft, rotates together with the camshaft in synchronization with the crankshaft of an engine, and drives a tappet provided at the base end section of a valve. With the rotation of the camshaft, the valve lift section of the cam equipped with the roller first makes contact with the tappet to press the tappet. Then, the contact position with the tappet is shifted from the valve lift section to the roller, and the roller presses the tappet this time. The roller presses the tappet while rotating on the tappet.

With this configuration, it is assumed that the following excellent advantages are obtained; since the roller of the cam equipped with the roller presses the tappet while moving and rolling on the tappet, the friction between the cam and the tappet can be reduced and fuel economy can be improved in comparison with a cam with no roller, and since the roller itself rotates on the tappet, the torque for driving the cam at a low-rotation region can be reduced.

However, in a type of tappet driven by a cam, a spherical crowning is formed on the face (top face) of the tappet making contact with the cam. In addition, in a type of cam, a crowning is formed on the face (cam face) of the cam making contact with a tappet. For example, JP-A-2011-117415 discloses a valve mechanism in which a crowning is formed on each of the top face of a tappet and the face of a cam. It is assumed that friction increase and the occurrence of uneven abrasion due to misalignment can be suppressed by properly setting the amount and the radius of curvature of each crowning.

However, in the case that a crowning is formed on each of the top face of the tappet and the face of the cam as disclosed in JP-A-2011-117415 described above, an axial thrust load may be generated on the cam depending on the contact position between the tappet and the cam, and the friction therebetween may increase. In particular, in the case of a cam structure with a roller, if an axial thrust load is generated on the roller, the roller may slide in the axial direction and the friction may increase. It is therefore desired to suppress the generation of the thrust load as much as possible.

SUMMARY

An object of the present invention is to provide a cam structure capable of reducing friction by suppressing any thrust load from generating in the axial direction of a roller at the time of contact with a tappet. However, without being limited to this object, matters capable of producing advantages that are brought by respective configurations described later in modes for embodying the present invention and that are not obtained by conventional technologies can also be regarded as other objects of the present invention.

According to an aspect of the invention, there is provided a cam structure which is configured to drive a tappet having a spherical crowning on a circular top face thereof and connected to abase end section of an intake valve or an exhaust valve of an engine, the cam structure comprising: a camshaft which is configured to rotate in synchronization with a crankshaft of the engine; a cam lobe which is mounted on the camshaft, and which includes: a base cam including: a base circular section having a mounting hole for the camshaft; and a valve lift section having a cut-out section being cut out in a tip end portion thereof; and a roller provided in the cut-out section and having a cylindrical section with a constant diameter, wherein a center section in a width direction of the base cam is adapted to make contact with the tappet at a position deviated from a center of the top face of the tappet, and the cylindrical section of the roller is adapted to make contact with the center of the top face of the tappet.

BRIEF DESCRIPTION OF THE DRAWINGS

FIG. 1(*a*) is a sectional view taken along arrow B-B in FIG. 2(*b*), showing a state in which a roller makes contact with a tappet, and FIG. 1(*b*) is an enlarged view showing an area around the center P of the tappet shown in FIG. 1(*a*).

FIG. 2(*a*) is a side view thereof, and FIG. 2(*b*) is a sectional view taken along arrow A-A in FIG. 2(*a*).

FIG. 4(*a*) is a sectional view corresponding to FIG. 1(*a*), showing a case in which the capacity of a pump is relatively high, FIG. 4(*b*) is an enlarged view showing the section E of FIG. 4(*a*), and FIG. 4(*c*) is a sectional view corresponding to FIG. 1(*a*), showing a case in which the capacity of the pump is insufficient.

FIG. 5(*a*) is a view showing a first modification, and FIG. 5(*b*) is a view showing a second modification.

DETAILED DESCRIPTION OF EXEMPLARY EMBODIMENTS

An embodiment will be described below using the drawings. However, the embodiment described below is merely an example and does not exclude various modifications or applications of techniques that are not explicitly stated in the embodiment described below.

(1. Configuration)

(1-1. Overall structure)

Figure 3:
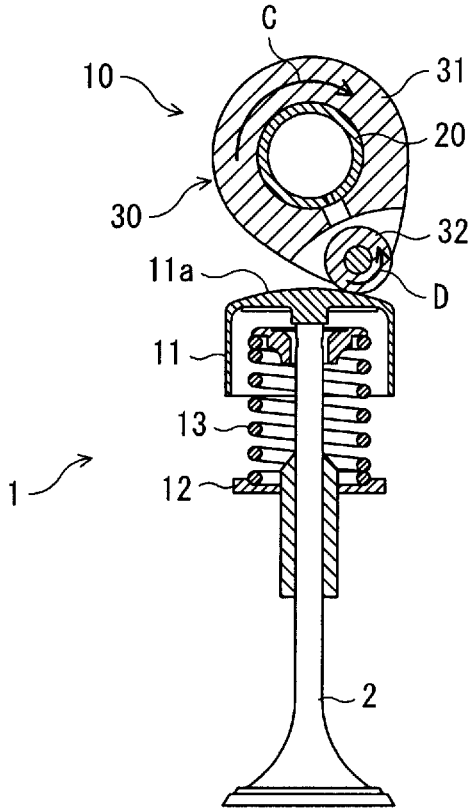
FIG. 3 is a sectional view showing the configuration of a valve mechanism in which the cam structure according to the embodiment is used.

As shown in FIG. 3, a cam structure 10 according to the embodiment is a component constituting the valve mechanism 1 of an engine mounted on a vehicle (these not shown) and is equipped with a camshaft 20 rotating in synchronization with the crankshaft (not shown) of the engine and a cam lobe 30 mounted on the camshaft 20.

The valve mechanism 1 is equipped with the cam structure 10, a capped cylindrical tappet 11 driven by the cam structure 10, a stationary section 12 secured to a cylinder head, not shown, and a spring 13 provided between the tappet 11 and the stationary section 12. The tappet 11 is also referred to as a valve lifter and is used to convert the rotary motion of the camshaft 20 into a reciprocating motion. The base end section of an intake valve or an exhaust valve (hereafter referred to as a valve 2) in each cylinder of the engine is connected to the tappet 11.

Figure 2A:
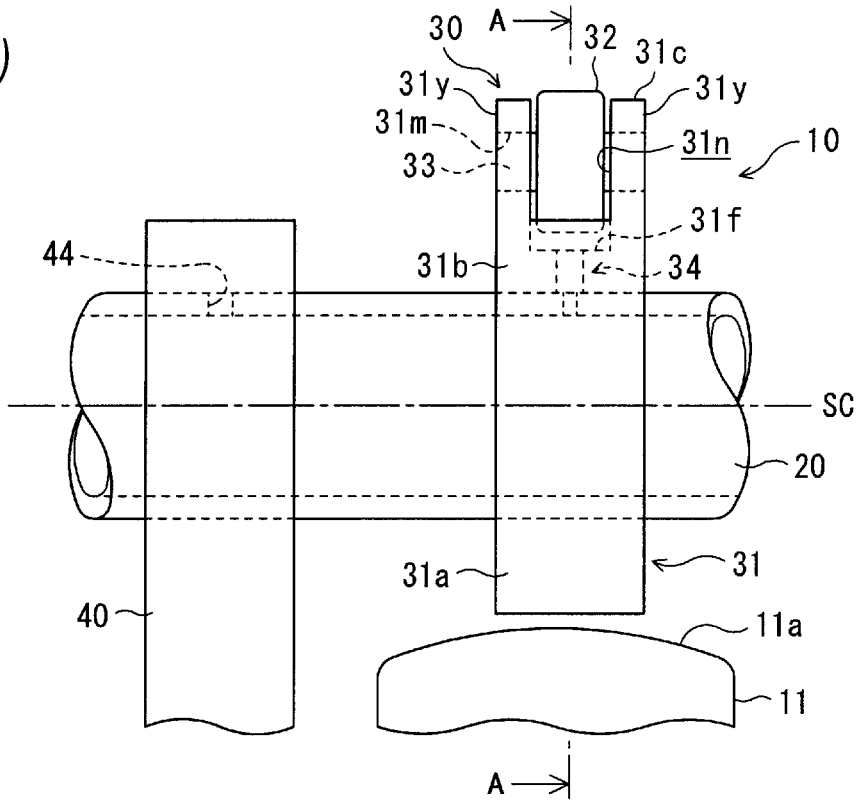
FIGS. 2(*a*) and 2(*b*) are schematic views showing the cam structure according to the embodiment.
Figure 2B:
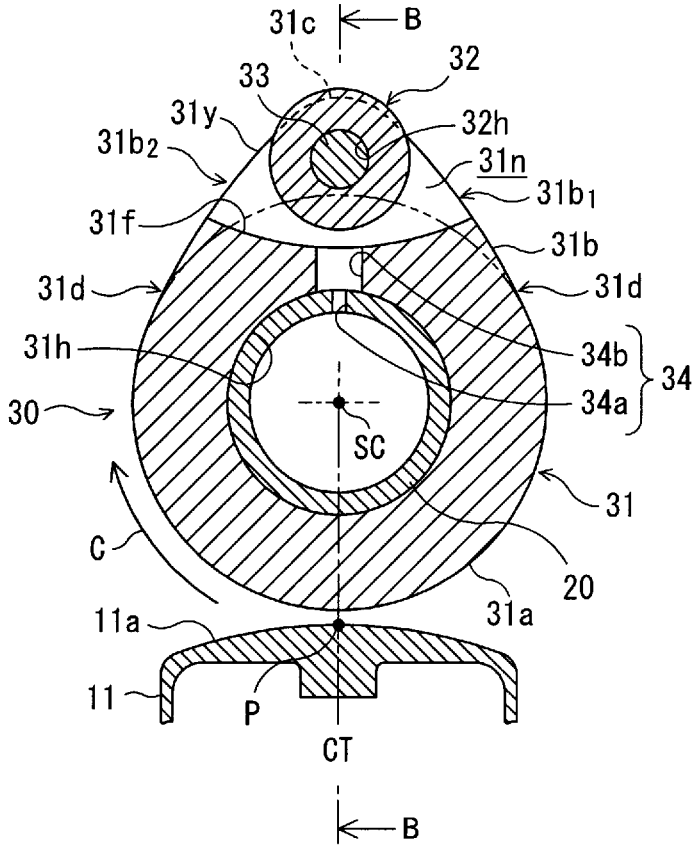

The tappet 11 is provided so that its opening is located on the side of the valve 2, and the base end section of the valve 2 and part of the spring 13 are disposed inside the cylindrical section of the tappet 11. A crowning having a partially spherical shape protruding toward the cam structure 10 is formed at the circular top face 11*a* (hereafter referred to as a tappet top face 11*a*) with which the cam lobe 30 makes contact. In other words, the tappet top face 11*a* is formed to serve as part of a spherical face having a curvature so that its center P becomes the most protruding point toward the cam structure 10. The center of the circle of the curvature is positioned on the axial center of the valve 2. As shown in FIG. 2(*b*), the axial center SC of the camshaft 20 is positioned on a normal line CT (hereafter referred to as a tappet center line CT) passing through the center P of the tappet top face 11*a*. The operation of the valve mechanism 1 will be described later.

(1-2. Cam structure)

As shown in FIGS. 2(*a*) and 2(*b*), the camshaft 20 is formed of a hollow pipe and is rotated when rotation is transmitted from the crankshaft of the engine via a timing chain or a timing belt (these not shown). Engine oil (lubricating oil, hereafter simply referred to as oil) force-fed by an oil pump (not shown) flows through the hollow interior of the camshaft 20.

The camshaft 20 is supported on the main body of the engine by a support section 40 and rotates with respect to the support section 40. Hence, a through-hole section 44 for supplying the oil to the contact section between the outer peripheral face of the camshaft 20 and the inner peripheral face of the support section 40 is provided at the portion in which the support section 40 of the camshaft 20 is installed. The oil flowing through the hollow interior of the camshaft 20 is supplied to the contact section between the camshaft 20 and the support section 40 via this through-hole section 44 to lubricate the contact section.

A plurality of cam lobes 30 for opening/closing the valves 2 are secured in the axial direction of the camshaft 20, the number of the cam lobes 30 corresponding to the number of the valves 2. Since the cam lobes 30 have configurations similar to one another, one of the cam lobes 30 is herein depicted and its structure is described.

The cam lobe 30 includes a base cam 31 serving as the main body of the cam and a roller 32 mounted on the base cam 31. The base cam 31 has a base circular section 31*a* and a valve lift section 31*b*, and its outer peripheral face continues in its entire circumferential direction. The base circular section 31*a* is the circular portion of the base cam 31, and a circular hole portion 31*h* (hereafter referred to as a camshaft mounting hole 31*h*) in which the camshaft 20 is mounted is formed in its center. In other words, the base circular section 31*a* corresponds to a portion in which the distance from the axial center SC of the camshaft 20 (the camshaft mounting hole 31*h*) is constant. A slight clearance is provided between the base circular section 31*a* and the tappet top face 11*a* to prevent unnecessary opening/closing operation of the valve 2.

The valve lift section 31*b* is a portion protruding from the base circular section 31*a* and a portion for pressing the tappet top face 11*a* to perform opening/closing operation of the valve 2. In FIG. 2(*b*), the boundary line between the base circular section 31*a* and the valve lift section 31*b* is indicated by a double chain line. The right side of the valve lift section 31*b* shown in FIG. 2(*b*) is a portion that is opposed to the tappet top face 11*a*, following the base circular section 31*a*, when the cam lobe 30 is rotated in the direction indicated by arrow C in the figure, and is a valve lift rising portion 31$b_1$ (the side for opening the valve 2).

The left side of the valve lift section 31*b* shown in FIG. 2(*b*) is a portion that is opposed to the tappet top face 11*a* after the roller 32 was opposed to the tappet top face 11*a*, when the cam lobe 30 is rotated in the direction indicated by arrow C in the figure, and is a valve lift lowering portion 31$b_2$ (the side for closing the valve 2). The respective base end sections 31*d* of the rising portion 31$b_1$ and the lowering portion 31$b_2$ of the valve lift section 31*b* are on the boundary line of the base circular section 31*a* and the valve lift section 31*b*. The rising portion 31$b_1$ and the lowering portion 31$b_2$ of the valve lift section 31*b* are herein formed to have the same cam profile. In other words, as shown in FIG. 2(*b*), the base cam 31 is plane-symmetric with respect to the plane passing through the axial center SC of the camshaft 20 and the tip end portion 31*c* of the valve lift section 31*b*.

The valve lift section 31*b* has a cut-out section 31*n* in its tip end portion (the top portion of the cam) 31*c*. The cut-out section 31*n* is a space formed by cutting out the valve lift section 31*b* in the range from the tip end portion 31*c* to a part of the base circular section 31*a* at the intermediate section in the width direction (in the insertion direction of the camshaft 20) of the base cam 31 so as to path through from the rising portion 31$b_1$ to the lowering portion 31$b_2$. In this cut-out section 31*n*, the roller 32, described later, is provided so as to be rotatable with respect to the base cam 31.

Figure 1A:
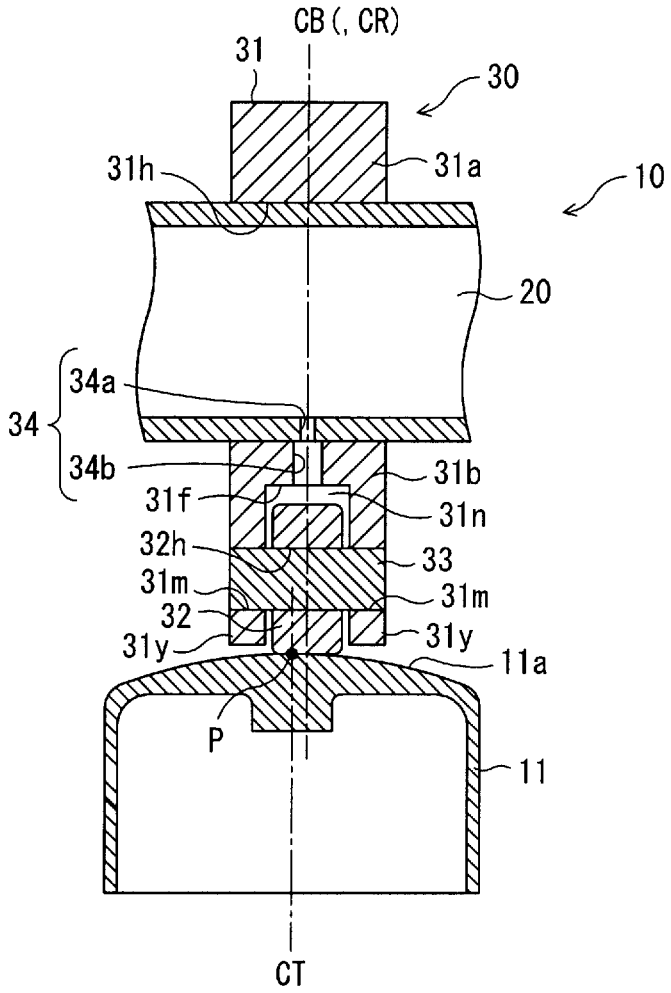
FIGS. 1(*a*) and 1(*b*) are views illustrating a cam structure according to an embodiment.
Figure 1B:
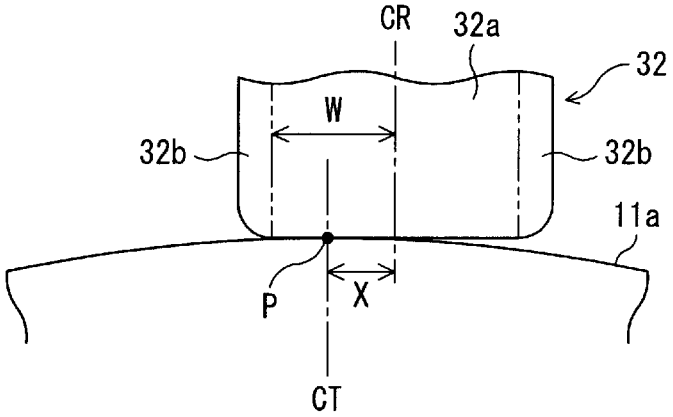

A pair of yoke sections 31*y* and 31*y*, opposed to each other, is formed on both sides in the width direction of the cut-out section 31*n* that is formed by cutting out the base cam 31. The yoke sections 31*y* and 31*y* opposed to each other have the same shape as that of the cut-out section 31*n* as viewed from the axial direction as shown in FIG. 2(*b*) and have the same width as viewed from the direction orthogonal to the axial direction as shown in FIGS. 1(*a*) and 2(*a*). In other words, the cut-out section 31*n* is formed at the central section in the width direction of the base cam 31 and is plane-symmetric with respect to a line CB (hereafter referred to as a base cam center line CB) passing through the center section in the width direction of the base cam 31 as shown in FIG. 1(*a*).

Hole sections 31*m* and 31*m* passing through in the width direction are provided linearly in the pair of the yoke sections 31*y* and 31*y* opposed to each other. The hole sections 31*m* are formed so that their center axes are parallel with the axial center SC of the camshaft mounting hole 31*h* formed in the base circular section 31*a*. A roller shaft 33 for mounting the roller 32 on the base cam 31 is inserted into the hole sections 31*m* and then mounted and secured to the base cam 31 by caulking. Hereafter, these hole sections 31*m* are referred to as roller shaft mounting holes 31*m*.

The roller 32 has a cylindrical section 32*a* having a constant diameter at the intermediate section in the axial direction as indicated by double chain lines in FIG. 1(*b*). The cylindrical section 32*a* has no crowning and is provided in a portion that makes contact with the tappet top face 11*a* when the roller 32 presses the tappet top face 11*a*. The roller 32 is disposed so that the cylindrical section 32*a* makes contact with the center P of the tappet top face 11*a*. The cylindrical section 32*a* has a cylindrical shape having a constant diameter and is linear in the cross section in the axial direction of the roller 32. Furthermore, a crowning section 32*b*, the diameter of which is reduced circularly toward the end portion of the roller 32, is provided at each of both the end sections in the axial direction of the roller 32 (both the end sections of the cylindrical section 32*a*). In other words, the roller 32 is provided with the so-called "partial crowning" in which the corners of the roller 32 are rounded in cross section in the axial direction.

A through hole 32*h* is formed at the center of the roller 32 into which the roller shaft 33 is inserted. The roller 32 is disposed in the cut-out section 31*n* so that the through hole 32*h* is aligned with the roller shaft mounting holes 31*m* formed in the yoke sections 31*y* and 31*y* of the base cam 31. The roller shaft 33 is inserted into the roller shaft mounting holes 31*m* and the through hole 32*h* so as to be parallel with the axial center SC of the camshaft 20 (the center axis of the camshaft mounting hole 31*h*), whereby the roller 32 is mounted on the base cam 31.

The roller 32 is mounted so that part of its outer peripheral face protrudes outward from the outer peripheral face of the tip end portion 31*c* of the valve lift section 31*b*. Furthermore, the roller 32 is disposed at the center section in the width direction of the cut-out section 31*n* so that the clearances to the two yoke sections 31*y* and 31*y* are nearly equal. Moreover, the opposed face 31*f* of the cut-out section 31*n*, opposed to the outer peripheral face of the roller 32, has a curved shape being bent toward the roller 32 (toward the tip end of the valve lift section 31*b*).

The roller 32 rotates with respect to the roller shaft 33 secured to the base cam 31. Hence, the contact face between the inner peripheral face of the through hole 32*h* of the roller 32 and the outer peripheral face of the roller shaft 33 serves as a portion (sliding section) that moves while sliding and requires proper lubrication. The cam structure 10 is equipped with an oil passage 34, described later, for supplying oil serving as lubricating oil to this sliding section.

As shown in FIG. 1(*a*), the cam lobe 30 is provided so that the base cam center line CB does not coincide with the tappet center line CT when the cam structure 10 and the tappet 11 are viewed from the direction orthogonal to the axial direction of the camshaft 20 and the tappet center line CT. In FIG. 1(*a*), the cam lobe 30 is provided so that the base cam center line CB is deviated rightward from the tappet center line CT. The cam lobe 30 is herein provided so that the base cam center line CB coincides with a line CR (hereafter referred to as a roller center line CR) passing through the center section in the axial direction of the roller 32.

In other words, the cam lobe 30 is provided so that the base cam center line CB coincides with the roller center line CR and so that the base cam center line CB and the roller center line CR do not coincide with the tappet center line CT (CB=CR≠CT). In other words, when the valve lift section 31*b* of the base cam 31 makes contact with the tappet top face 11*a*, the cam lobe 30 is provided so that the center section in the width direction of the base cam 31 makes contact with the tappet top face 11*a* at a position deviated from the center P of the tappet top face 11*a*.

Furthermore, the roller 32 is provided so that the cylindrical section 32*a* makes contact with the center P of the tappet top face 11*a*. In other words, as shown in FIG. 1(*b*), when it is assumed that the displacement (deviation amount) between the tappet center line CT and the roller center line CR is X and that the length (that is, half of the length in the width direction of the cylindrical section 32*a*) from the roller center line CR to the end section of the cylindrical section 32*a* is W, the roller 32 and the tappet 11 are disposed so as to satisfy the following expression (1).

$$0 \leq X \leq W \quad (1)$$

However, the roller 32 is herein provided so that the roller center line CR coincides with the base cam center line CB and the cam lobe 30 is provided, and the cam lobe 30 is provided so that the base cam center line CB is deviated from the tappet center line CT, whereby the deviation amount X has a value larger than 0 ($0<X\leq W$).

(1-3. Structure of the oil passage)

Next, the oil passage 34 in the cam structure 10 according to the embodiment will be described using FIG. 1(*a*) and FIG. 2(*b*). The oil passage 34 is a passage through which the oil flowing through the hollow interior of the camshaft 20 is supplied to the sliding section of the roller 32. The oil passage 34 is provided so that the hollow interior of the camshaft 20 communicates with the cut-out section 31*n* formed in the base cam 31 in a state in which the cam lobe 30 is mounted on the camshaft 20. In other words, portions constituting the oil passage 34 are respectively formed beforehand in the camshaft 20 and the base cam 31, and a single passage (that is, the oil passage 34) is formed by mounting the cam lobe 30 on the camshaft 20.

The oil passage 34 has two portions being different in flow passage cross-section area. One portion is a throttle section 34*a* for limiting the flow rate of the oil to be supplied to the roller 32, and the other portion is an oil reservoir section 34*b* for storing the oil. The throttle section 34*a* is provided in the camshaft 20, and the oil reservoir section 34*b* is provided in the base cam 31.

The throttle section 34*a* is formed as a through hole passing through the outer peripheral face of the camshaft 20, one end of which is open to the hollow interior of the camshaft 20 and the other end of which is open to the outer peripheral face of the camshaft 20. The throttle section 34*a* is provided on the side of the hollow interior of the camshaft 20 (the upstream side of the oil passage 34), instead of the side of the oil reservoir section 34*b*, and serves as a portion into which the oil to be supplied from the hollow interior of the camshaft 20 to the roller 32 first flows. The flow passage cross-section area of the throttle section 34*a* is made smaller than that of the oil reservoir section 34*b*. The flow passage cross-section area of the throttle section 34*a* is smaller than that of the through-hole section 44 through which the above-mentioned contact section between the camshaft 20 and the support section 40 is lubricated.

On the other hand, one end of the oil reservoir section 34*b* is open to the opposed face 31*f* of the cut-out section 31*n* and the other end thereof is open to the camshaft mounting hole 31*h*. In other words, the oil reservoir section 34*b* is formed as a through hole passing from the camshaft mounting hole 31*h* to the opposed face 31*f* of the cut-out section 31*n*. The oil reservoir section 34*b* is a portion into which the oil having passed through the throttle section 34*a* flows and from which the oil leaks out to the side of the roller 32. The oil reservoir section 34*b* is also a portion in which the oil that has not leaked out to the side of the roller 32 because of the viscosity of the oil is stored. When the cam lobe 30 is mounted on the camshaft 20, the mounting is carried out so that the throttle section 34*a* communicates with the oil reservoir section 34*b* to form the single oil passage 34.

(2. Action and Operation)

First, the operation of the valve mechanism 1 having the cam structure 10 will be described using FIG. 3. As shown in FIG. 3, when the camshaft 20 is rotated in the direction indicated by arrow C in synchronization with the crankshaft of the engine, the cam lobe 30 is rotated together with the camshaft 20. At this time, while the base circular section 31*a* of the base cam 31 is opposed to the tappet top face 11*a* (that is, before the state shown in FIG. 3), a clearance is provided between the base circular section 31*a* and the tappet top face 11*a* as describe above, whereby no pressing force is exerted from the base circular section 31*a* to the tappet 11. Hence, the valve 2 is not opened or closed but is held in its fully closed state by the elastic force of the spring 13.

When the cam lobe 30 is then rotated further and when the tappet top face 11*a* becomes away from the base circular section 31*a* of the base cam 31 and starts making contact with the valve lift section 31*b*, the tappet 11 is pressed by the valve lift section 31*b*. Hence, the valve 2 is pressed downward together with the tappet 11 and starts opening (the valve lift starts rising) against the elastic force of the spring 13.

At this time, as shown in FIG. 1(*a*), the center section in the width direction of the valve lift section 31*b* makes contact with the tappet top face 11*a* at a position deviated from the center P of the tappet top face 11*a*. Hence, as the camshaft 20 is rotated, the tappet 11 is rotated around the tappet center line CT. With this configuration, the position of the contact point between the valve lift section 31*b* and the tappet top face 11*a* is prevented from always becoming the same position.

When the cam lobe 30 is rotated further and when the tappet top face 11*a* stops making contact with the valve lift section 31*b* and starts making contact with the roller 32 as shown in FIG. 3, the roller 32 is moved while being rotated on the tappet top face 11*a* in the direction indicated by arrow D in the figure. In other words, the roller 32 presses the tappet 11. Hence, the valve 2 is pressed further against the elastic force of the spring 13, the amount of the valve lift increases and becomes the maximum finally. At this time, as shown in FIGS. 1(*a*) and 1(*b*), the cylindrical section 32*a* of the roller 32 always makes contact with the center P of the tappet top face 11*a*, whereby no thrust load is generated in the axial direction.

After the amount of the valve lift has become the maximum, the tappet top face 11*a* stops making contact with the roller 32 and starts making contact with the valve lift section 31*b*, contrary to the above description, whereby the valve 2 is pressed upward by the elastic force of the spring 13 and starts closing (the valve lift starts lowering). Furthermore, when the tappet top face 11*a* stops making contact with the valve lift section 31*b* and becomes close to the base circular section 31*a*, the pressing force to the tappet 11 is not exerted, and the valve 2 is fully closed. The valve mechanism 1 repeats this kind of operation during the rotation of the camshaft 20.

Figure 4A:
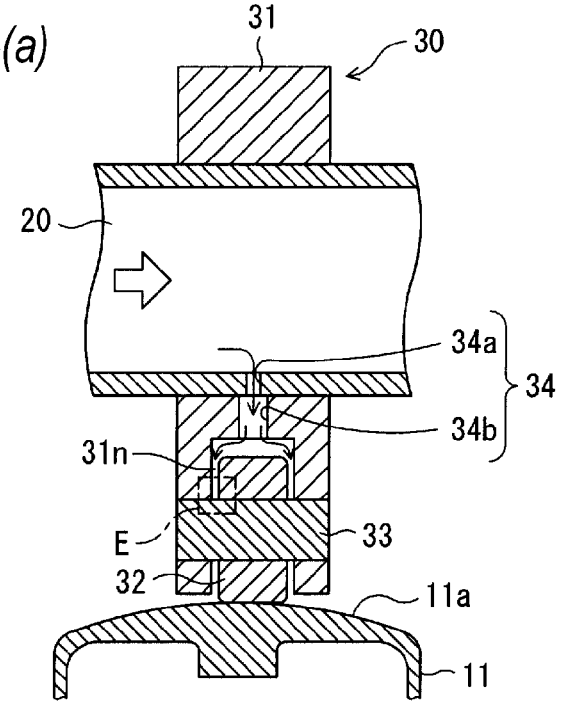
FIGS. 4(*a*), 4(*b*) and 4(*c*) are views illustrating the lubrication of the cam structure according to the embodiment.
Figure 4B:
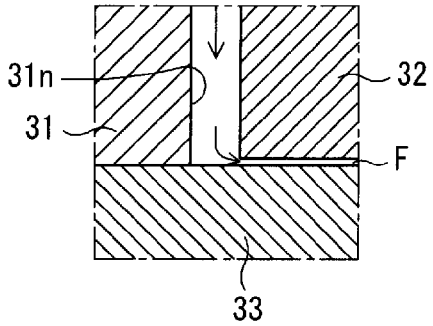
Figure 4C:
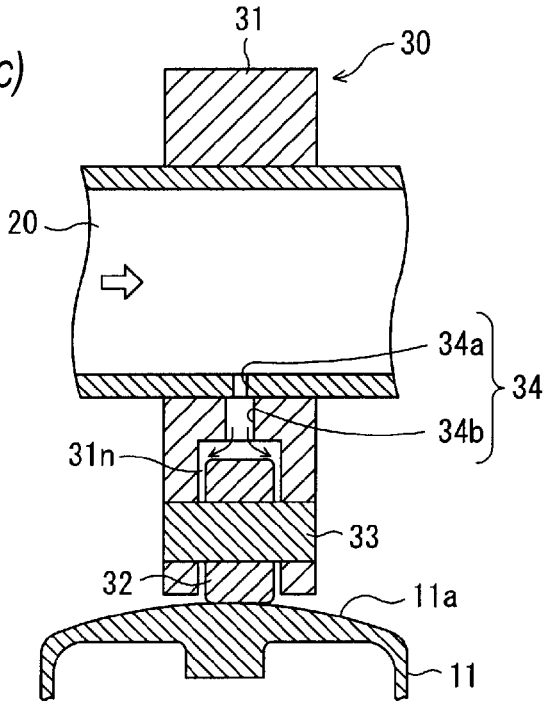

Next, lubrication to the sliding section of the roller 32 in the cam structure 10 will be described using FIGS. 4(*a*) to 4(*c*). As shown in FIG. 4(*a*), in the case that the pressure of the engine oil is high, the oil force-fed by the oil pump flows through the hollow interior of the camshaft 20 as indicated by a void arrow in the figure and is supplied to the cut-out section 31*n* through the oil passage 34 as indicated by arrows. The oil supplied to the cut-out section 31*n* forms an oil film, not shown, between the cam lobe 30 and the tappet top face 11*a* and also forms an oil film F on the sliding section of the roller 32.

In other words, when the roller 32 starts making contact with the tappet top face 11*a*, the roller 32 is rotated, whereby, as shown in FIG. 4(*b*), the oil supplied to the cut-out section 31*n* is drawn into the space between the inner peripheral face of the roller 32 and the outer peripheral face of the roller shaft 33 by the wedge effect obtained by the rotation of the roller 32. As a result, the oil film F is formed in the space between the inner peripheral face of the roller 32 and the outer peripheral face of the roller shaft 33, and the friction at the sliding section of the roller 32 is reduced by the oil film F.

Since the throttle section 34*a* having a small flow passage cross-section area is provided on the upstream side of the oil passage 34 (on the side of the hollow interior of the camshaft 20), the flow rate of the oil is restricted by the throttle section 34*a*. Hence, in the case that the capacity of the oil pump is relatively high and that the pressure of the engine oil is high, it is possible to prevent a large amount of the oil from being supplied to the side of the roller 32 and to prevent the pressure of the oil from lowering, whereby a proper amount of the oil can be supplied to the cut-out section 31*n*. Furthermore, the oil having not leaked out to the cut-out section 31*n* is stored in the oil reservoir section 34*b* located on the downstream side of the throttle section 34*a*.

In the case that the rotation speed of the engine is very low and that the pressure of the engine oil is low, for example, during idle operation or start-up, the oil stored in the oil reservoir section 34*b* is effectively used. As shown in FIG. 4(*c*), even in the case that the pressure of the engine oil is low, the oil force-fed by the oil pump flows through the hollow interior of the camshaft 20 as indicated by a void arrow in the figure but cannot pass through the throttle section 34*a* of the oil passage 34.

Hence, in this case, the oil stored in the oil reservoir section 34*b* leaks out to the cut-out section 31*n* when the roller 32 makes contact with the tappet 11 (that is, when the cut-out section 31*n* is located below the oil reservoir section 34*b*. Then, in a manner similar to that described above, the oil film F is formed on the sliding section of the roller 32 by the wedge effect shown in FIG. 4(*b*), whereby the friction at the sliding section is reduced.

Furthermore, an oil film is also formed on the tappet top face 11*a* by the oil leaked out from the cut-out section 31*n* to the tappet top face 11*a*. In other words, the oil reservoir section 34*b* functions as a buffer (a device used to smooth out fluctuations) for achieving adequate and stable oil supply, regardless of the presence or absence of fluctuations in the pressure of the engine oil. In particular, since the roller 32 in the cam structure 10 is provided with the cylindrical section 32*a*, in the case that misalignment occurs, the oil film between the tappet top face 11*a* and the roller 32 may become very thin. However, since the oil reservoir section 34*b* is provided, it is possible to prevent a situation in which oil shortage occurs.

(3. Advantage)

Consequently, with the cam structure 10 according to the embodiment, since the cylindrical section 32*a* having a constant diameter is provided for the roller 32 and the cylindrical section is provided so as to make contact with the center of the tappet top face, it is possible to prevent the generation of any thrust load in the axial direction of the roller 32 when the roller 32 makes contact with the tappet top face 11*a*. Hence, the friction of the roller 32 is reduced, whereby the abrasion of the roller 32 can be suppressed and fuel economy can be improved. In addition, the torque for driving the cam at a low-rotation region can be reduced.

Furthermore, since the center section in the width direction of the base cam 31 is provided so as to make contact with the tappet 11 at a position deviated from the center P of the tappet top face 11*a*, the tappet 11 can be rotated around the tappet center line CT. Hence, the friction between the cam lobe 30 and the tappet 11 can be reduced and oil film exhaustion on the tappet top face 11*a* can be avoided. Moreover, uneven abrasion caused by the friction when the cam lobe 30 continuously makes contact with the tappet top face 11*a* at the same position can be prevented.

In addition, since a spherical crowning is formed on the top face 11*a* of the tappet 11, the contact between the edge (corner section) of the cam lobe 30 and the tappet top face 11*a* can be prevented in the case of misalignment, whereby the surface pressure at the top face 11*a* can be suppressed from rising.

Besides, since the cut-out section 31*n* is formed at the center section in the width direction of the base cam 31 and the center section in the axial direction of the roller 32 provided in the cut-out section 31*n* coincides with the center section in the width direction of the base cam 31, the clearances formed between the roller 32 and the pair of yoke sections 31*y* and 31*y* can be made equal. Hence, the oil for lubricating the roller 32 is prevented from deviating to either side and oil shortage is prevented, whereby the lubrication of the roller 32 can be made excellent.

Still further, since the rising portion 31$b_1$ and the lowering portion 31$b_2$ of the valve lift section 31*b* of the cam lobe 30 are formed to have the same cam profile, the cam lobe 30 can be mounted without considering its mounting direction. In other words, since the front and rear sides of the cam lobe 30 have the same shape, the cam lobe 30 can be mounted on the camshaft 20, regardless of its direction. Hence, the work for discriminating the front and rear faces of the cam lobe 30 is unnecessary and the man-hours for the work can be reduced. In addition, since it is possible to eliminate a risk of making a mistake in the mounting direction of the cam lobe 30, the productivity of the mechanism can be enhanced.

Furthermore, in the cam structure 10, since the flow rate of the oil to be supplied to the side of the roller 32 can be restricted by the throttle section 34*a* of the oil passage 34 for allowing communication between the hollow interior of the camshaft 20 and the cut-out section 31*n* of the base cam 31, the pressure of the engine oil can be prevented from lowering. As a result, the work for driving the oil pump can be reduced and fuel economy can be improved further.

Moreover, since the oil passage 34 is provided with the throttle section 34*a*, in the case that the rotation speed of the engine is low and that the pressure of the engine oil is low, for example, during idle operation or start-up, the oil flowing through the hollow interior of the camshaft 20 cannot flows into the oil passage 34 (cannot pass through the throttle section 34*a*) in some cases. However, in the cam structure 10 according to the embodiment, the oil can be stored in the oil reservoir section 34*b* of the oil passage 34. Hence, even when the pressure of the oil is low as described above, the oil can be supplied from the oil reservoir section 34*b* to the cut-out section 31*n*. As a result, even when the pressure of the engine oil is low, the friction at the sliding section of the roller 32 can be reduced.

Furthermore, since the cylindrical section 32*a* is provided at the portion of the roller 32 making contact with the tappet top face 11*a* in the cam structure 10, in the case that misalignment occurs, the oil film between the tappet top face 11*a* and the roller 32 may become very thin. However, since the oil reservoir section 34*b* is provided in the oil passage 34, oil shortage can be prevented and the friction at the tappet top face 11*a* can be reduced.

Besides, since the throttle section 34*a* and the oil reservoir section 34*b* being different in flow passage cross-section area are formed in the camshaft 20 and the base cam 31, respectively, in the case that the cam lobe 30 is mounted on the camshaft 20 by press-fitting or the like, the fluidity of the oil can be ensured regardless of the degree of dimensional accuracy of the camshaft 20 in the axial direction. In other words, both improvement in assembly workability and improvement in lubricity can be achieved. In addition, since the throttle section 34*a* and the oil reservoir section 34*b* are formed in the camshaft 20 and the base cam 31, respectively, they can be processed easily.

In particular, in the embodiment, the oil reservoir section 34*b* is a through hole formed in the base cam 31 so as to be open to the camshaft mounting hole 31*h* and to the cut-out section 31*n*. In addition, the throttle section 34*a* is a through hole passing through the outer peripheral face of the camshaft 20. Furthermore, since these two through holes are combined to form the single oil passage 34, the processing for forming the through holes is facilitated and the man-hours for forming the oil passage 34 can be suppressed.

Besides, since the through-hole section 44 for supplying the oil to the contact section between the outer peripheral face of the camshaft 20 and the inner peripheral face of the support section 40 is provided at the portion in which the support section 40 of the camshaft 20 is installed, the oil is supplied to the contact section between the camshaft 20 and the support section 40 via the through-hole section 44. Although the camshaft 20 strongly makes contact with the support section 40, the friction at the contact section between the camshaft 20 and the support section 40 can be reduced securely by making the flow passage cross-section area of the through-hole section 44 larger than that of the throttle section 34*a*. Furthermore, since the strength of the contact between the camshaft 20 and the support section 40 is higher than that at the sliding section of the roller 32, oil leakage rarely occurs and the pressure of the engine oil is hardly lowered.

Since the roller 32 is formed into a partial crowning shape having the cylindrical section 32*a* and the crowning sections 32*b* in the embodiment, in the case that misalignment occurs, damage of the tappet top face 11*a* caused by the edges of the roller 32 can be prevented more securely.

(4. Modification)

Although the embodiment according to the present invention has been described above, the present invention is not limited to the above-mentioned embodiment and can be modified variously in a range without departing from the gist of the present invention.

(4-1. Modification of the Oil Passage)

Figure 5A:
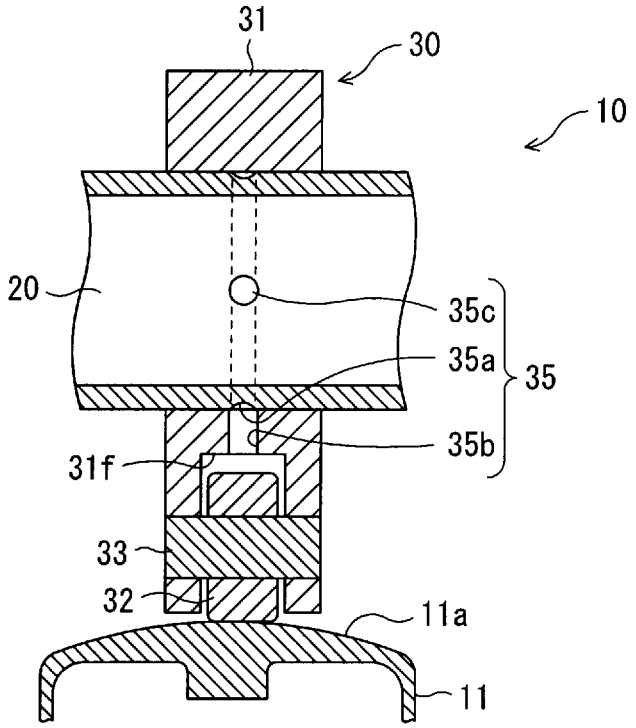
FIGS. 5(*a*) and 5(*b*) are sectional views showing modifications of the oil passage of the cam according to the embodiment.
Figure 5B:
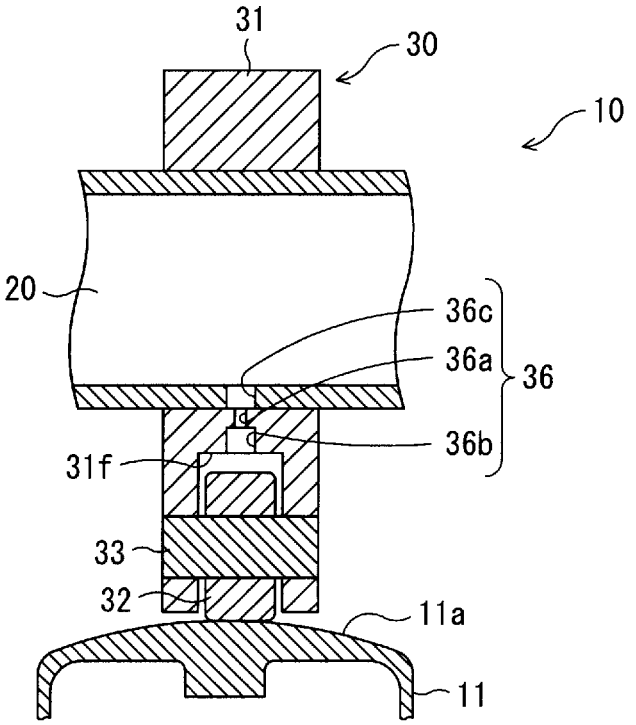

For example, the oil passage 34 provided in the cam structure 10 described in the above-mentioned embodiment may be modified to such a configuration as shown in FIGS. 5(*a*) and 5(*b*).

The oil passage 35 shown in FIG. 5(*a*) is equipped with a throttle section 35*a* for restricting the flow rate of the oil to be supplied to the roller 32 and an oil reservoir section 35*b* for storing the oil and further equipped with an oil supplying section 35*c* for supplying the oil to the throttle section 35*a*. The throttle section 35*a* and the oil supplying section 35*c* are provided in the camshaft 20, and the oil reservoir section 35*b* is provided in the base cam 31. Since the oil reservoir section 35*b* is the same as the oil reservoir section 34*b*, its description is omitted.

The oil supplying section 35*c* is formed as a through hole passing through the outer peripheral face of the camshaft 20, one end of which is open to the hollow interior of the camshaft 20 and the other end of which is open to the outer peripheral face of the camshaft 20. The oil supplying section 35*c* is provided on the side of the hollow interior of the camshaft 20 (the most upstream side of the oil passage 35), instead of the sides of the throttle section 35*a* and the oil reservoir section 35*b*. The oil to be supplied from the hollow interior of the camshaft 20 to the side of the roller 32 first flows into the oil supplying section 35*c*. The size of the oil supplying section 35*c* is arbitrary, preferably equal to or slightly larger than the groove width of the throttle section 35*a* described later. In addition, the position in the circumferential direction of the oil supplying section 35*c* is also arbitrary, whereby the oil supplying section 35*c* can be formed regardless of the direction of the cam lobe 30.

The throttle section 35*a* is a groove formed so as to be recessed in the outer peripheral face of the camshaft 20 at least in the range between the oil supplying section 35*c* and the oil reservoir section 35*b*. The throttle section 35*a* is configured as an annular groove formed around the outer peripheral face of the camshaft 20. The size of the groove (the width of the groove and its depth from the outer peripheral face of the camshaft 20) corresponds to the flow passage cross-section area of the throttle section 35*a* and is set so as to be smaller than the flow passage cross-section area of the oil reservoir section 35*b*.

The oil supplying section 35*c* is formed by drilling a hole at a position coincident with part of the throttle section 35*a*. During the assembly of the camshaft 20 and the cam lobe 30, they are assembled so that the throttle section 35*a* serving as a groove formed on the outer peripheral face of the camshaft 20 becomes coincident with the oil reservoir section 35*b* and so that the single oil passage 35 is formed by the oil supplying section 35*c*, the throttle section 35*a* and the oil reservoir section 35*b*.

In other words, the oil passage 35 of the cam structure 10 according to this modification is provided in the order of the oil supplying section 35*c*, the throttle section 35*a* and the oil reservoir section 35*b* from the upstream side (the side of the hollow interior of the camshaft 20). The oil flowing through the hollow interior of the camshaft 20 passes through the oil supplying section 35*c* and flows into the throttle section 35*a*. The flow rate of the oil is restricted by the throttle section 35*a* on the outer peripheral face of the camshaft 20 and the oil flows into the oil reservoir section 35*b*. The oil is then supplied from the oil reservoir section 35*b* to the cut-out section 31*n* and an oil film is formed on the sliding section of the roller 32.

Consequently, an advantage similar to that of the above-mentioned embodiment can be obtained by the cam structure 10 according to this modification. Furthermore, since the throttle section 35*a* is a groove recessed in the outer peripheral face of the camshaft 20, the position in the rotation direction in which the throttle section 35*a* is formed is not required to be aligned with the direction of the cam lobe 30, in comparison with the case of the above-mentioned embodiment in which the throttle section 34*a* is formed as a through hole. Furthermore, since the position of the oil supplying section 35*c* in the rotation direction can be set arbitrarily, the processing of the oil passage 35 can be made easier.

The throttle section 35*a* may merely be formed at least in the region between the oil supplying section 35*c* and the oil reservoir section 35*b* and may also be formed in the base cam 31 instead of the outer peripheral face of the cam lobe 30. In other words, at least in the region between the oil supplying section 35*c* and the oil reservoir section 35*b*, the throttle section 35*a* may also be configured as a groove recessed in the camshaft mounting hole 31*h* formed in the base cam 31. Even in the oil passage 35 configured as described above, an advantage similar to the above-mentioned advantage can be obtained.

In addition, the oil passage 36 shown in FIG. 5(*b*) is equipped with a throttle section 36*a* for restricting the flow rate of the oil to be supplied to the side of the roller 32, an oil reservoir section 36*b* for storing the oil, and an oil supplying section 36*c* for supplying the oil to the throttle section 36*a*. The oil supplying section 36*c* is provided in the camshaft 20, and the throttle section 36*a* and the oil reservoir section 36*b* are provided in the base cam 31.

Like the oil supplying section 35*c* shown in FIG. 5(*a*), the oil supplying section 36*c* is formed as a through hole passing through the outer peripheral face of the camshaft 20, one end of which is open to the hollow interior of the camshaft 20 and the other end of which is open to the outer peripheral face of the camshaft 20. The oil supplying section 36*c* is provided on the side of the hollow interior of the camshaft 20 (the most upstream side of the oil passage 36), instead of the sides of the throttle section 36*a* and the oil reservoir section 36*b*. The oil to be supplied from the hollow interior of the camshaft 20 to the side of the roller 32 first flows into the oil supplying section 36*c*. The flow passage cross-section area of the oil supplying section 36*c* is larger than that of the throttle section 36*a*, described later.

Both the throttle section 36*a* and the oil reservoir section 36*b* are formed in the base cam 31, thereby forming a single through hole. In other words, the through hole formed in the base cam 31, one end of which is open to the camshaft mounting hole 31*h* and the other end of which is open to the cut-out section 31*n*, is a stepped hole consisting of two holes having different diameters in the longitudinal direction of the through hole. The throttle section 36*a* is one of the two holes of the stepped hole, being located on the side of the hollow interior of the camshaft 20 and open to the camshaft mounting hole 31*h*.

The oil reservoir section 36*b* is located closer to the side of the roller 32 than the throttle section 36*a*, has a flow passage cross-section area larger than that of the throttle section 36*a*, and is open to the cut-out section 31*n*. During the assembly of the camshaft 20 and the cam lobe 30, their positions in the rotation direction are aligned so that the oil supplying section 36*c* communicates with the throttle section 36*a*. In other words, the assembly is carried out so that the single oil passage 36 is formed by the oil supplying section 36*c*, the throttle section 36*a* and the oil reservoir section 36*b*.

In other words, the oil passage 36 of the cam structure 10 according to this modification is provided in the order of the oil supplying section 36*c*, the throttle section 36*a* and the oil reservoir section 36*b* from the upstream side (the side of the hollow interior of the camshaft 20). The oil flowing through the hollow interior of the camshaft 20 passes through the oil supplying section 36*c* and flows into the throttle section 36*a*. The flow rate of the oil is restricted by the throttle section 36*a* and the oil flows into the oil reservoir section 36*b*. The oil is then supplied from the oil reservoir section 36*b* to the cut-out section 31*n* and an oil film is formed on the sliding section of the roller 32.

Consequently, an advantage similar to that of the above-mentioned embodiment can be obtained by the cam structure 10 according to this modification. Furthermore, the conventional cam structure can be changed to the cam structure 10 by merely additionally processing the base cam 31 to provide a stepped hole. Hence, the manufacturing cost of the cam structure can be reduced. Furthermore, in the oil passage 36 according to this modification, since the throttle section 36*a* is provided in the cam lobe 30, the flow passage length of the throttle section 36*a* can be set so as to be different from the thickness of the outer peripheral face of the camshaft 20. In other words, it is possible to adjust the throttle amount of the oil to be restricted by the throttle section 36*a*.

(4-2. Others)

In the above-mentioned embodiment, the roller 32 having a partial crowning shape has been described as an example. However, the roller may merely be provided with at least the cylindrical section 32*a*. In other words, a roller having a constant diameter in the axial direction may also be used. Even in a roller having no crowning sections 32*b*, in the case that misalignment occurs, the edge of the roller can be prevented from making contact with the tappet top face 11*a* by the crowning of the tappet top face 11*a*.

In addition, in the above-mentioned embodiment, the configuration in which the cut-out section 31*n* formed in the base cam 31 is positioned at the center of the intermediate section in the width direction of the tip end portion 31*c* of the valve lift section 31*b* has been described as an example. However, the position of the cut-out section 31*n* is not limited to the center but the cut-out section 31*n* may be provided so as to be deviated from the center. Furthermore, although the base cam 31 in which the cut-out section 31*n* is formed in the region from the tip end portion 31*c* of the valve lift section 31*b* to part of the base circular section 31*a* has been described as an example, the cut-out section 31*n* may be provided by cutting out only the valve lift section 31*b*. Moreover, the shape of the opposed face 31*f* of the cut-out section 31*n* is not limited to the above-mentioned shape but may be a flat plane shape.

Moreover, the rising portion $\mathbf{31}b_1$ and the lowering portion $\mathbf{31}b_2$ of the base cam 31 are not required to be formed to have the same cam profile, and their specific shapes (the amount of the lift and the operation angle thereof) may be set appropriately according to the specifications of each engine. What's more, the size of the roller 32 and the protruding amount of the roller 32 from the base cam 31 are not limited to those shown in the figures and can be set appropriately.

Besides, although the center section in the axial direction of the roller 32 is provided so as to coincide with the center section in the width direction of the base cam 31 and they make contact with each other at a position deviated from the center P of the tappet top face 11*a* in the above-mentioned embodiment, the roller center line CR may be displaced from the base cam center line CB (CR≠CB). Furthermore, the pair of yoke sections 31*y* and 31*y* provided on both sides in the width direction of the cut-out section 31*n* may be formed so as to have the same width.

Still further, although the cam structure 10 in which the roller 32 rotates with respect to the roller shaft 33 secured to the base cam 31 has been described in the above-mentioned embodiment, it may be possible to use a cam structure in which the roller 32 is secured to the roller shaft 33 and the roller shaft 33 rotates with respect to the base cam 31. More and more, it may be possible that the roller 32 is rotatable with respect to the roller shaft 33 and the roller shaft 33 is also rotatable with respect to the base cam 31. Even in these cases, oil is supplied to the cut-out section 31*n*, whereby an oil film is formed on the sliding section of the roller 32 and the friction at the sliding section can be reduced.

According to as aspect of the invention, since the cylindrical section having a constant diameter is provided with the roller and the cylindrical section is provided so as to make contact with the center of the tappet top face, it is possible to prevent the generation of any thrust load in the axial direction of the roller when the roller makes contact with the tappet top face. Hence, the friction of the roller is reduced, whereby the abrasion of the roller can be suppressed and fuel economy can be improved. In addition, the torque for driving the cam at a low-rotation region can be reduced.

According to as aspect of the invention, since the center section in the width direction of the base cam is provided so as to make contact with the tappet at a position deviated from the center of the tappet top face, the tappet can be rotated around the axis passing through the center of the tappet. Hence, the friction between the cam lobe and the tappet can be reduced and oil film exhaustion on the tappet top face can be avoided. Moreover, uneven abrasion caused by the friction when the cam lobe continuously makes contact with the same position can be prevented.

According to as aspect of the invention, since a spherical crowning is formed on the top face of the tappet, the contact between the edge (corner section) of the cam lobe and the top face of the tappet can be prevented in the case of misalignment, whereby the surface pressure at the top face can be suppressed from rising.

What is claimed is:

1. A cam structure which is configured to drive a tappet having a spherical crowning on a circular top face thereof and connected to a base end section of an intake valve or an exhaust valve of an engine, the cam structure comprising:

a camshaft which is configured to rotate in synchronization with a crankshaft of the engine;

a cam lobe which is mounted on the camshaft, and which includes:

a base cam including: a base circular section having a mounting hole for the camshaft; and a valve lift section having a cut-out section being cut out in a tip end portion thereof; and a roller provided in the cut-out section and having a cylindrical section with a constant diameter, wherein a center section in a width direction of the base cam is adapted to make contact with the tappet at a position deviated from a center of the circular top face of the tappet, and the cylindrical section of the roller is adapted to make contact with the center of the circular top face of the tappet.

2. The cam structure according to claim 1, wherein the cut-out section is formed in the center section in the width direction of the base cam, and a center section in an axial direction of the roller coincides with the center section in the width direction of the base cam.

3. The cam structure according to claim 2, wherein a rising portion and a lowering portion of the valve lift section are formed to have the same cam profile.

4. The cam structure according to claim 3, wherein the camshaft is formed in a shape having a hollow interior, in the camshaft and the base cam, an oil passage communicating with the hollow interior of the camshaft and the cut-out section, and adapted to allow oil flowing through the hollow interior to be supplied to the roller is provided, and the oil passage includes:

an oil reservoir section being open to an opposed face of the cut-out section, which is opposed to an outer peripheral face of the roller; and a throttle section formed closer to a side of the hollow interior than the oil reservoir section, a flow passage cross-section area of the throttle section being smaller than that of the oil reservoir section.

5. The cam structure according to claim 4, wherein the oil reservoir section is formed in the base cam, and the throttle section is formed in the camshaft.

6. The cam structure according to claim 5, wherein the oil reservoir section is a through hole formed in the base cam so as to be open to a mounting hole for the camshaft, and the throttle section is a through hole passing through an outer peripheral face of the camshaft.

7. The cam structure according to claim 2, wherein the camshaft is formed in a shape having a hollow interior, in the camshaft and the base cam, an oil passage communicating with the hollow interior of the camshaft and the cut-out section, and adapted to allow oil flowing through the hollow interior to be supplied to the roller is provided, and the oil passage includes:

an oil reservoir section being open to an opposed face of the cut-out section, which is opposed to an outer peripheral face of the roller; and a throttle section formed closer to a side of the hollow interior than the oil reservoir section, a flow passage cross-section area of the throttle section being smaller than that of the oil reservoir section.

8. The cam structure according to claim 7, wherein
the oil reservoir section is formed in the base cam, and
the throttle section is formed in the camshaft.

9. The cam structure according to claim 8, wherein
the oil reservoir section is a through hole formed in the base cam so as to be open to a mounting hole for the camshaft, and
the throttle section is a through hole passing through an outer peripheral face of the camshaft.

10. The cam structure according to claim 1, wherein
the camshaft is formed in a shape having a hollow interior, in the camshaft and the base cam, an oil passage communicating with the hollow interior of the camshaft and the cut-out section, and adapted to allow oil flowing through the hollow interior to be supplied to the roller is provided, and
the oil passage includes:
an oil reservoir section being open to an opposed face of the cut-out section, which is opposed to an outer peripheral face of the roller; and
a throttle section formed closer to a side of the hollow interior than the oil reservoir section, a flow passage cross-section area of the throttle section being smaller than that of the oil reservoir section.

11. The cam structure according to claim 10, wherein
the oil reservoir section is formed in the base cam, and
the throttle section is formed in the camshaft.

12. The cam structure according to claim 11, wherein
the oil reservoir section is a through hole formed in the base cam so as to be open to a mounting hole for the camshaft, and
the throttle section is a through hole passing through an outer peripheral face of the camshaft.

13. The cam structure according to claim 10, wherein
the oil passage includes an oil supplying section adapted to supply the oil from the hollow interior of the camshaft to the throttle section.

14. The cam structure according to claim 13, wherein
the oil supplying section is a through hole passing through an outer peripheral face of the camshaft,
the throttle section is a groove formed so as to be recessed between the oil supplying section and the oil reservoir section, and
the oil reservoir section is a through hole formed in the base cam so as to be open to a mounting hole for the camshaft.

15. The cam structure according to claim 13, wherein
the oil supplying section is a through hole passing through an outer peripheral face of the camshaft,
the throttle section is a through hole formed in the base cam between the oil supplying section and the oil reservoir section, and
the oil reservoir section is a through hole formed in the base cam so as to be open to a mounting hole for the camshaft.

* * * * *